US005837336A

United States Patent [19]

Ichimura et al.

[11] Patent Number: 5,837,336

[45] Date of Patent: Nov. 17, 1998

[54] FILM-WRAPPED ARTICLES WITH IMPROVED OPENING PROPERTIES

[75] Inventors: Yuji Ichimura; Tatsuo Fujii, both of Saku, Japan

[73] Assignee: TDK Corporation, Tokyo, Japan

[21] Appl. No.: 753,419

[22] Filed: Nov. 25, 1996

[30] Foreign Application Priority Data

Dec. 1, 1995 [JP] Japan ..... 7-335717

[51] Int. Cl.[6] ..... B65D 85/575; B65D 65/10

[52] U.S. Cl. ..... 428/34.9; 428/35.1; 428/195; 428/198; 428/200; 428/212; 428/913; 206/387.1; 206/497; 206/813; 229/87.05; 383/211

[58] Field of Search ..... 428/34.9, 35.2, 428/35.7, 195, 198, 202, 35.1, 200, 212, 913; 206/387.1, 813, 497; 229/87.05; 383/210, 211

[56] References Cited

U.S. PATENT DOCUMENTS

| | | | |
|---|---|---|---|
| 5,011,014 | 4/1991 | Borck et al. | 206/387.1 |
| 5,067,612 | 11/1991 | Tsuchiya et al. | 229/87.05 |
| 5,129,518 | 7/1992 | Tanaka et al. | 229/87.05 |
| 5,293,994 | 3/1994 | Antik | 206/387.1 |
| 5,423,423 | 6/1995 | Sato et al. | 229/87.05 |
| 5,487,503 | 1/1996 | Sato et al. | 229/87.05 |
| 5,505,375 | 4/1996 | Sato et al. | 206/387.1 |
| 5,511,664 | 4/1996 | Aramaki et al. | 206/387.1 |
| 5,560,538 | 10/1996 | Sato et al. | 229/87.05 |
| 5,645,211 | 7/1997 | Shimada | 229/87.05 |

FOREIGN PATENT DOCUMENTS

| | | |
|---|---|---|
| 60-193821 | 10/1985 | Japan . |
| 5-310263 | 11/1993 | Japan . |
| 6-336261 | 12/1994 | Japan . |
| 6-85273 | 12/1994 | Japan . |
| 7-11564 | 2/1995 | Japan . |

*Primary Examiner*—Rena L. Dye
*Attorney, Agent, or Firm*—Wood, Phillips, VanSanten, Clark & Mortimer

[57] ABSTRACT

A film-wrapped article consisting of a rectangular product wrapped with a heat-shrinkable plastic film in intimate contact therewith, the upper and under edge portions of the film being overlapped and sealed together along the body of the wrap to form a seal. A part of the seal on one side of the article is formed as a weakly joined zone whose adhesion strength increases by continuous or stepwise gradations from an opening zone where the adhesion strength is the lowest toward the both ends of the article. The weakly joined zone is made up of joined and unjoined regions extending along the interface between the upper and under edge portions, in a repetitive pattern of the regions varying in adhesion strength with changes in the area ratio of the joined and unjoined regions. The wrap has a cut for unwrapping use made in the opening or neighboring zone of the upper edge portion.

3 Claims, 7 Drawing Sheets

| | A | B |
|---|---|---|
| ① | 0.9 | 0.3 |
| ② | 0.4 | 0.8 |
| ③ | 0.8 | 0.4 |
| ④ | 1.0 | 0.2 |

FILM-WRAPPED ARTICLES WITH IMPROVED OPENING PROPERTIES

BACKGROUND OF THE INVENTION

This invention relates to film-wrapped articles with improved opening and sealing properties, and more specifically to means for opening wraps over rectangular objects such as cases of magnetic and optical recording media overwrapped with tight-fitting wrap film.

To facilitate unwrapping of rectangular objects such as cases of magnetic and optical recording media overwrapped with tight-fitting wrap film, various opening means have thus far been used or suggested.

Typical opening means of the prior art are roughly divided into two types: tear tape affixed to the inner side of a tightly-fitting wrap film, and a non-tear tape type which comprises a weakly joined or unjoined strip provided along a seal where the both edge portions of a wrap film are overlapped.

An exemplary wrapped object using tear tape is shown at in FIG. 7(*a*). A wrapper of heat-shrinkable plastic film 1 is fitted tightly around the four sides of a product 7 (a rectangular object of a single magnetic tape cassette or of a plurality of such cassettes), and the two edge portions are overlapped to form a seal 2. A length of tear tape is affixed to the inner side of the film 1, with one end 5 exposed from the wrap. Where necessary the wrap film 1 is nicked along the both edges of the tear tape 3.

Pulling the end 5 of the tear tape 3 to tear open the wrap often results in the removal of only the tear tape and the wrap portion to which the tape is affixed, as in FIG. 7(*b*). The wrap film portion 1-2 is easy to peel away, but the most part 1-1 remains in intimate contact with the article 7 and can hardly be removed. Costliness is another demerit of the tear tape type.

Provision of an unjoined zone in part of the seal formed by overlapping the edge portions of wrap film is taught by Japanese Patent Application Kokai Nos. 2-109870 (BASF) and 60-193821 (Okura Industrial Co.), Utility Model Application Kokai No. 6-78273, etc. For example, in Utility Model Application Kokai No. 6-78273, as shown in FIG. 8(*a*), an unjoined zone 9 is formed in a part of seal 2 where two edge portions of a tightly wrapping film 1 overlap. The unjoined zone 9 may have a cut 13 (and sometimes an additional cut 15) made along it in the peeling direction.

When the wrap is to be opened, the unjoined zone 9 is pulled up with fingers. The resulting fracture should develop along the cuts 13, 15 until the film 1 is torn open. However, experience tells otherwise; in many instances only a fragment 11 is torn away as in FIG. 8(*b*). The film 1 mostly remains in such close contact with the article that it can scarcely be peeled away. An additional disadvantage common to the prior art wraps of the character is that the unjoined zone is not sealed tightly enough to keep off dust. The wrap according to Patent Application Kokai No. 60-193821 has no cut and is difficult to tear open. A further problem is that dust can gain entrance into the wrap through a gap 4 that is naturally formed by the unjoined zone 9.

Another type providing a weakly joined zone adjacent to an unjoined zone in the seal where the both edge portions of wrap film overlap, is disclosed in Patent Application Kokai 6-336261 (Sony Corp.), etc. As illustrated in FIG. 9, a seal 2 forming an overlap between the two edge portions of a wrap film 1 is made up of a weakly joined zone 17, unjoined zone 18, strongly joined zone 16, and cut 19. The cut 19 allows the unjoined zone 18 to curl up slightly upon shrink packaging. The resulting curl facilitates pulling for easy tearing of the film but mars the appearance of the package. The curl can lead to tearing up to the weakly joined zone, impairing the package integrity and its merchandising appeal. The wrap film overlap portion that has the cut 19 is not sealed and hence has poor sealing property. Moreover, the weakly joined zone 17 forms such a small proportion of the seal, the remainder being the strongly joined zone 16, that the wrap is not easy to tear open.

According to Utility Model Application Kokai No. 6-85273 (Fuji Photo Film Co.), as shown at in FIG. 10(*a*), there are formed an unjoined zone 21, two weakly joined zones 23, 25, and a strongly joined zone 22 in part of a seal 2 where the both edge portions of a wrap film I are overlapped. The weakly joined zones 23, 25 have cuts 27, 29, respectively, made at their outer ends. To peel the film away, the unjoined zone 21 is forced upright with a nail, with concomitant separation of the weakly joined zones 23, 25 by the peeling force of the nail or finger applied in the directions A and B. Eventually all the zones from the cut 27 to the cut 29 are forced upright and the seal 2 is completely pulled open. This type provides a tight seal but is not easy to open, since the film edge portions must be peeled off in advance up to the both end cuts 27, 29. The unjoined zone 21 rises above the remainder of the surface and thereby mars the appearance of the package. It can get caught by something outside, leading to unintended tear. Further, the strongly joined zone 22 that lies alongside the unjoined zone 21 and weakly joined zones 23, 25 hampers opening; it sometimes causes the wrap film to fracture slightly along the boundary between itself and the unjoined zone 21, preventing the whole wrap from being torn open.

Utility Model Application Kokai No. 7-11564 (Fuji Photo Film) teaches another arrangement. As shown in FIG. 11, it comprises an unjoined zone 31 provided in a part of a seal 2 where two edge portions of a wrap film 1 overlap, a weakly joined zone 33 whose adhesion strength is enhanced as the distance from the unjoined zone increases, through adjustment of the density of a dot pattern of slightly blocking ink, and a strongly joined zone 32 extending outwardly of the weakly joined zone 33, with a cut 35 made in the portion of the strongly joined zone 32 adjacent to the opposite end of the unjoined zone 31. To unwrap, the portion of the unjoined zone 31 close to the cut 35 is scratched with a nail. The action peels the adjacent seal portion up to the cut 35 and the weakly joined zone 33 and thence the strongly joined seal portion 2 along the weakly joined zone 33. The system provides a good seal, but the strongly joined zone 32 extending along the unjoined zone 31 and weakly joined zone 33 impedes unwrapping. As already explained in conjunction with FIG. 10, the presence of the strongly joined zone can occasionally cause fracture of the wrap film between that zone and the opening portion into a small fraction, thus hampering complete unwrapping. The unjoined zone 31 rises above the remainder of the surface to the detriment of the package appearance. Also, it can be caught by something external and be torn unexpectedly.

As will be appreciated from the foregoing, all the opening means of the prior art for the seal formed by overlapping the meeting edge portions of a wrap film and providing an unjoined zone with or without a weakly joined zone in part of the seal have a common disadvantage of inability to fully satisfy the requirements for good opening and sealing properties.

The present invention has for its object to provide film wraps over rectangular articles, such as cases holding magnetic or optical recording media, including opening means which exhibit good sealing and opening properties without tear tape, and have an unjoined zone easy to pull open, the wraps showing good quality and fine appearance.

SUMMARY OF THE INVENTION

The present invention solves the problems of the prior art in the following way. A film-wrapped article is made by applying a piece of heat-shrinkable plastic film to a rectangular object (a case of a magnetic tape cassette, floppy disc, optical disc, etc. or a stack of such cases) in intimate contact with its periphery, overlapping the both edge portions of the film, and heat sealing the overlap to form a seal. The seal extending along the body of the wrap is free of unjoined or strongly joined zones but consists nearly entirely of a weakly joined zone whose adhesion strength increases by continuous or stepwise gradations from the opening portion where the adhesion strength is the lowest toward the remainder of the zone.

In one aspect of the invention, a film-wrapped article is provided which consists of a rectangular product wrapped with a heat-shrinkable plastic film in intimate contact therewith, the upper and under edge portions of the film being overlapped and sealed together along the body of the wrap to form a seal. A part of the seal on one side of the article is formed as a weakly joined zone whose adhesion strength increases by continuous or stepwise gradations from an opening zone where the adhesion strength is the lowest toward the both ends of the article. The weakly joined zone is made up of joined and unjoined regions extending along the interface between the upper and under edge portions, in a repetitive pattern of the regions varying in adhesion strength with changes in the area ratio of the joined and unjoined regions. The wrap has a cut made in the opening zone or nearby portion of the upper edge portion, from the exposed end of the upper edge inwardly, as an auxiliary opening means. Preferably, the cut is made in a weakly joined zone of greater adhesion strength than the opening zone, formed between one end of the article and the opening zone.

In another aspect of the invention, a film-wrapped article is provided which consists of a rectangular product wrapped with a heat-shrinkable plastic film in intimate contact therewith, the upper and under edge portions of the film being overlapped and sealed together along the body of the wrap to form a seal. Nearly all of the seal on one side of the article is formed as a weakly joined zone whose adhesion strength increases by continuous or stepwise gradations from a portion of the lowest adhesion strength along the exposed end of the upper edge portion toward the end of the under edge portion. The weakly joined zone is made up of joined and unjoined regions extending along the interface between the upper and under edge portions, in a repetitive pattern of the regions varying in adhesion strength with changes in the area ratio of the joined and unjoined regions, the wrap having a cut for unwrapping use made in the upper edge portion, from the exposed end inwardly.

BRIEF DESCRIPTION OF THE DRAWINGS

FIG. 6(*a*) is a detail view taken where indicated in FIG. 6;

DETAILED DESCRIPTION OF THE INVENTION

The present invention offers the following advantages. The seal of the wrap, without any unjoined portion, is kept tight fitting, completely shutting out dust. The weakly joined zones are made up of unjoined and joined regions with a repetition of lattice, mesh, dotted or other pattern. Through adjustment of the area ratio of those regions, the zones can be optimumly and easily formed.

In unwrapping, the opening zone where the adhesion is the weakest is pulled out with fingers. Since the cut formed in the opening or nearby portion acts as auxiliary opening means, the upper edge portion is easily pulled up. Continued pulling permits complete unwrapping because substantially all the body seal is made up of weakly joined zones.

The invention thus satisfactorily provides both good sealing and easy opening properties and facilitates the manufacture of film-wrapped articles.

The adhesion strength of the weakly joined zones is increased as the distance from the opening zone increases, so that, when fracture accidentally occurs in the opening zone, the fracture is kept from growing or extending to other zones. Where an adhesion strength capable of preventing such an unintended peel and permitting easy peel when necessary is attained, the weakly joined zones may have only two step gradations in adhesion strength, in the opening and other zones. Preferably, either at least three stepwise gradations or continuous gradation is provided.

The invention will be more fully described below with reference to the accompanying drawings.

Figure 1:
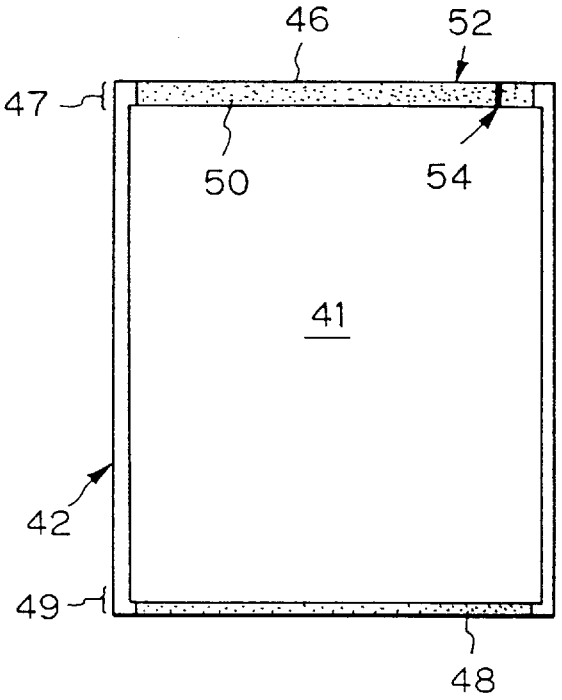
FIG. 1 is a plan view of a first embodiment of the wrap film of the present invention, showing a body seal portion as a weakly adherent zone with gradations in adhesion strength.
Figure 2:
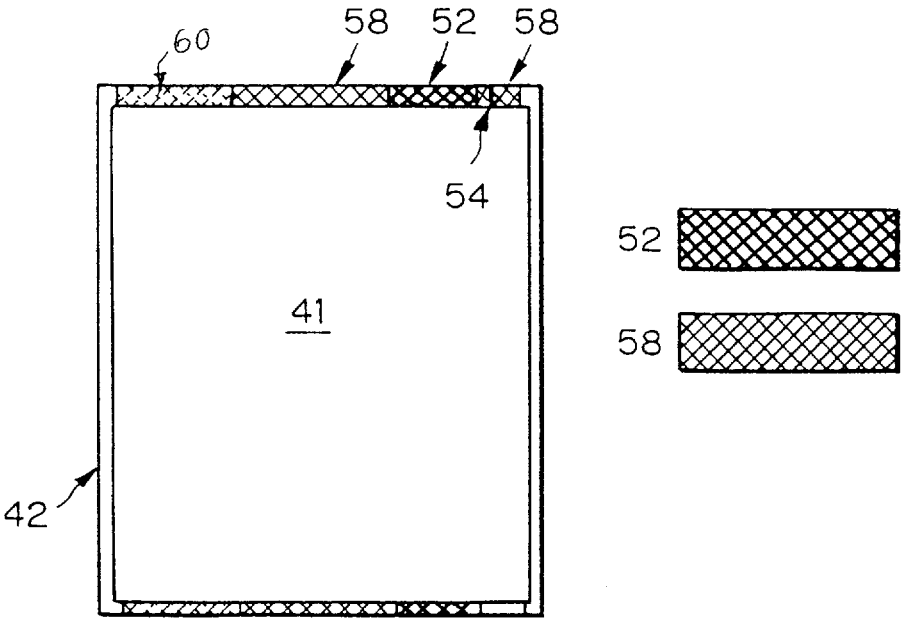
FIG. 2 is a plan view of a second embodiment of the wrap film of the invention, showing a body seal portion as a weakly adherent zone with gradation in adhesion strength.
Figure 3:
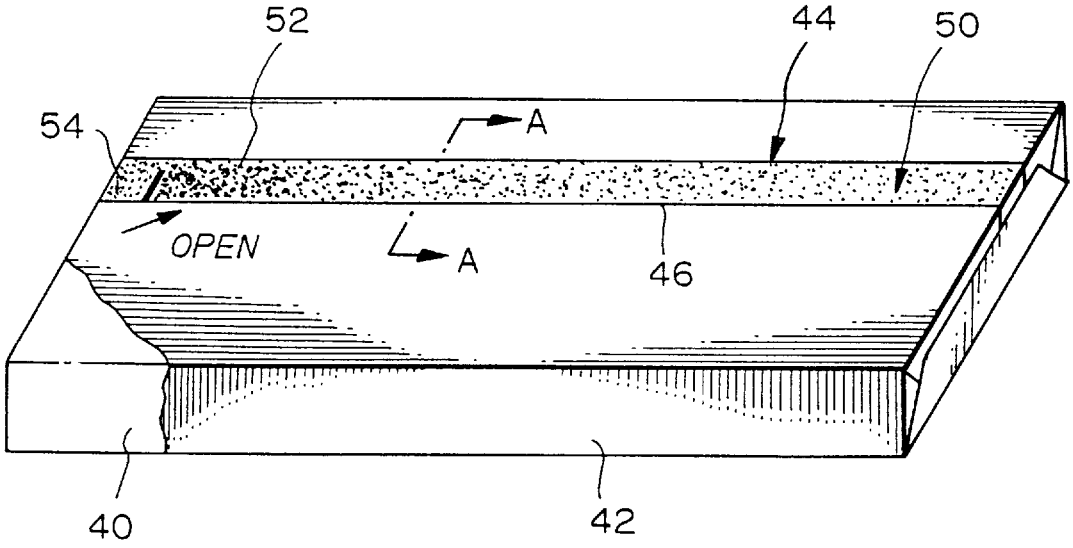
FIG. 3 is a perspective view of an article wrapped with the first embodiment of the wrap film of the invention.

In FIG. 1, there is shown the first embodiment of a wrap film of the invention, and in FIG. 2, the second embodiment. The wrap is formed of a well-known material such as heat-shrinkable polypropylene film. FIG. 3 illustrates an article wrapped with the film of FIG. 1, in perspective.

First Embodiment

First, the embodiment shown in FIGS. 1 and 3 will be explained. A wrap film 42 for shrink packaging is formed by cutting or slitting a long web of sheet printed with a repetitive pattern into pieces of a predetermined size, each consisting of a design surface 41, upper edge portion 47, and under edge portion 49. Each border zone between the design surface 41 and an adjoining design surface (not shown) is printed with a pattern to form a weakly joined zone 50. The method of forming the pattern will be clarified later. Although the same pattern is shown on the upper edge portion 47 and under edge portion 49, only the pattern on the former that is to constitute a weakly joined zone 50 is of significance. The pattern on the under edge portion 49 is the remain of the allowance provided for deviation in cutting or slitting of the material sheet to secure the weakly adherent zone 50 at all times.

The wrap film, when wrapping a rectangular article 40 such as a cassette case, is folded so that the under edge portion 49 is in intimate contact with the rectangular article, the side free of pattern (on the rear side as viewed in FIG. 1) faces upward, and the upper edge portion 47 comes over the under edge portion, with the pattern that is to form the weakly joined zone 50 facing downward, leaving the extreme film edge portion 46 exposed. Heat sealing forms a seal 44 that includes the weakly joined zone 50 along the interface of the two edge portions.

The structure of the pattern that constitutes the weakly joined zone 50 will now be explained. For the sake of simplicity, the same terms will be used for the corresponding portions of the weakly joined zone 50 and the pattern.

As shown in FIG. 1, the pattern in the zone 50 is formed of dots printed with a non-adherent, heat-resisting printing ink. In the embodiment shown the pattern is designed to have gradations in adhesion strength. First, the pattern has an opening zone 52 which has the lowest adhesion strength. Here the region of (black) dots of printing ink has the largest area, with the ratio of total dot area or printed area to the unprinted area being so chosen as to provide an adhesion strength adequate for the joining of the upper and under edge portions but low enough to permit easy tearing with a nail. From this opening zone 52 rightward and leftward to the ends of the package, the dot area decreases gradually. The both ends of the weakly joined zone must allow easy break-away.

In heat sealing, a heater plate having a mirror-smooth heat-sealing surface of a configuration corresponding to the weakly joined zone is pressed against the surface to be sealed where the upper and under edge portions of the wrap film overlap. The portions having the dotted pattern printed with non-adherent ink remain unjoined, while unprinted portions are joined together. Care must be taken at this time to avoid heat sealing of any non-pattern portion of the overlap between the upper and under edge portions 47, 49; otherwise a strongly joined zone can result and pose a problem.

The weakly joined zone may be formed in other ways. For example, a heater plate having a heat-sealing surface formed with dents like dots or latticework is pressed against a wrap film in such manner that the film portion in contact melts but the portion out of contact remains unmelted. A film 42 is made from a heat-adhesive material such as polypropylene, and a heater plate having a heat-sealing surface with a lattice-like pattern corresponding to the weakly adherent zone 50 is heated and pressed against the overlapped zone of the upper and under edge portions of the film. Ultrasonic energy may be utilized for the heating purpose.

Figure 6:
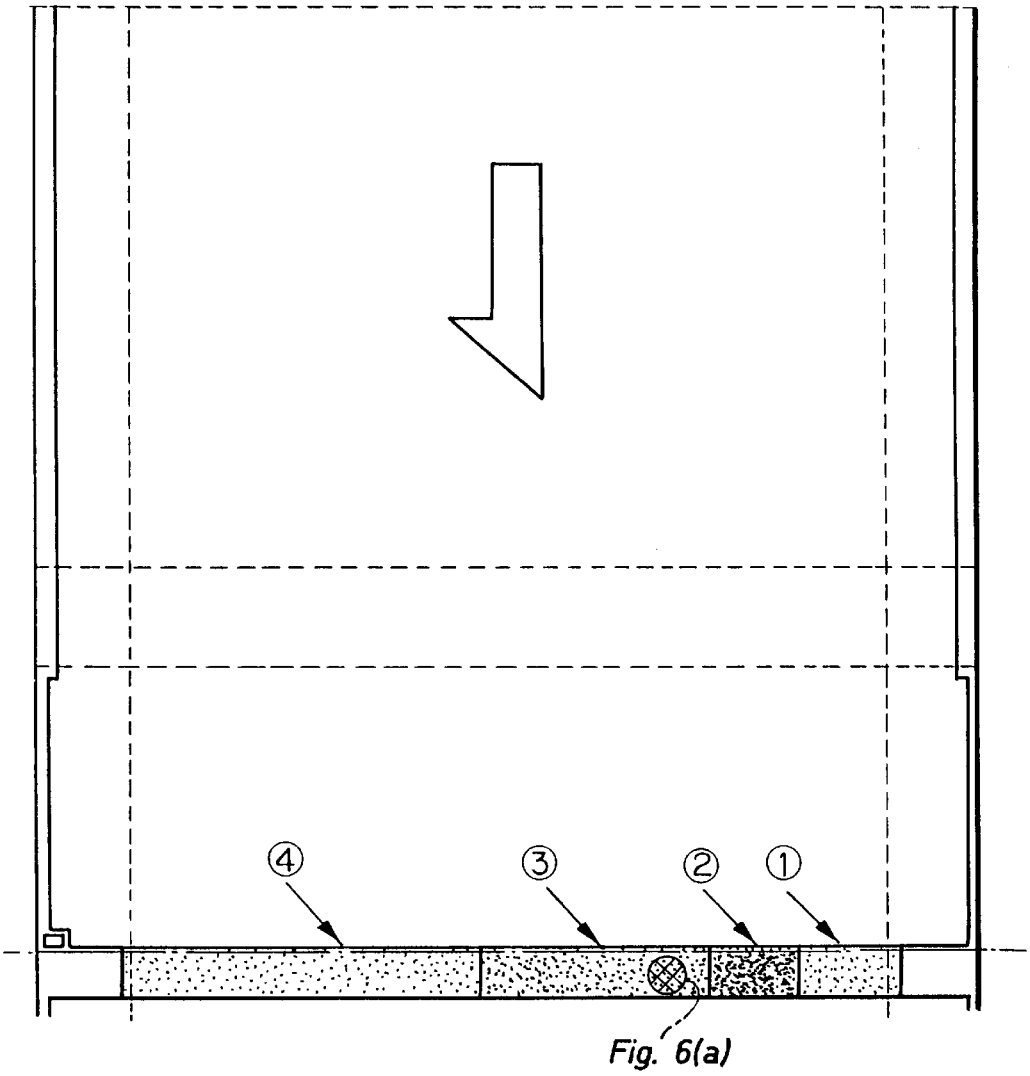
FIG. 6 is an enlarged view of essential parts of the second embodiment.
Figure 6A:
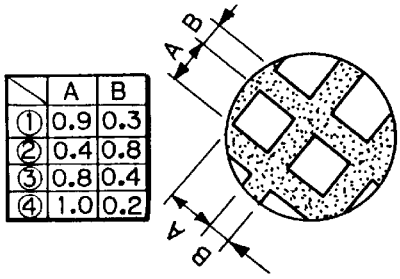
Figure 7A:
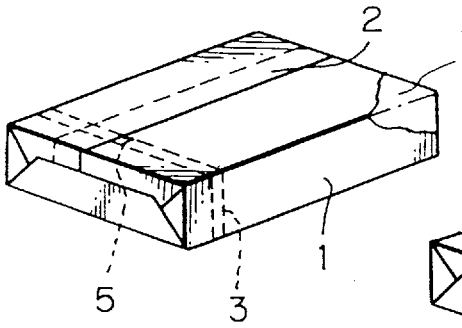
Fig. 7(a) PRIOR ART
FIG. 7 is a perspective view (a) of a conventional film-wrapped article using a tear tape, and a perspective view (b) of the same as unwrapped.
Figure 7B:
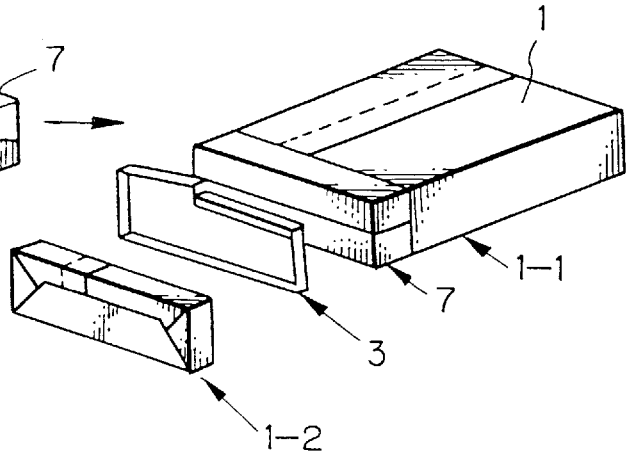
Fig. 7(b) PRIOR ART
Figure 8A:
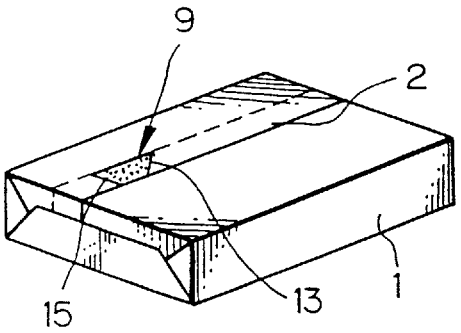
Fig. 8(a) PRIOR ART
FIG. 8 is a perspective view (a) of a conventional film-wrapped article using no tear tape, and a perspective view (b) of the same as unwrapped.
Figure 8B:
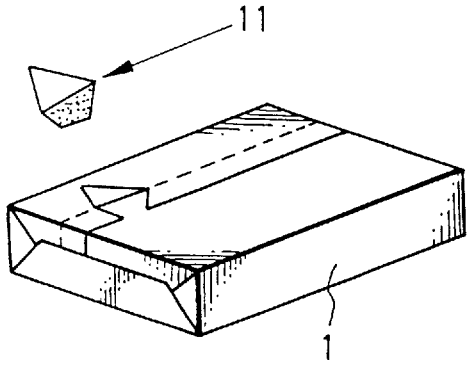
Fig. 8(b) PRIOR ART
Figure 9:
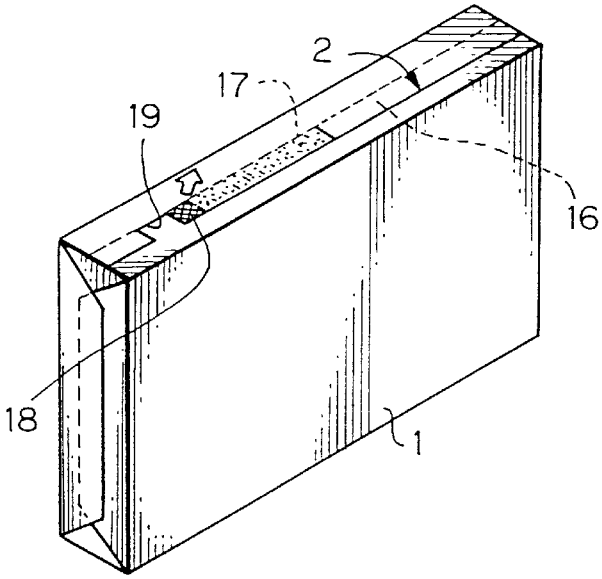
Fig. 9 PRIOR ART
FIG. 9 is a perspective view of still another conventional film-wrapped article not using a tear tape.
Figure 10A:
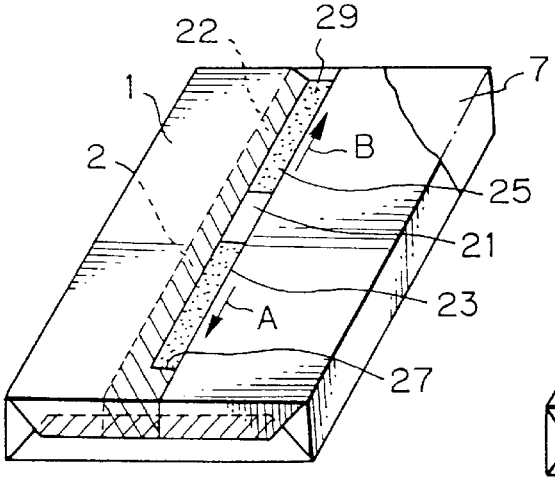
Fig. 10(a) PRIOR ART
FIG. 10 is a perspective view (a) of yet another tear tape-free film-wrapped article of the prior art and a perspective view (b) of the same as unwrapped.
Figure 10B:
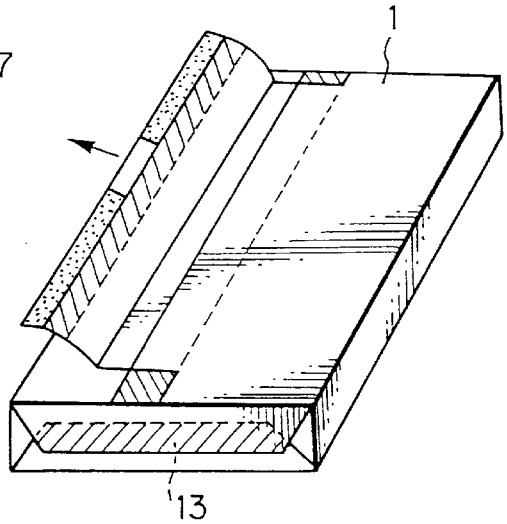
Fig. 10(b) PRIOR ART
Figure 11:
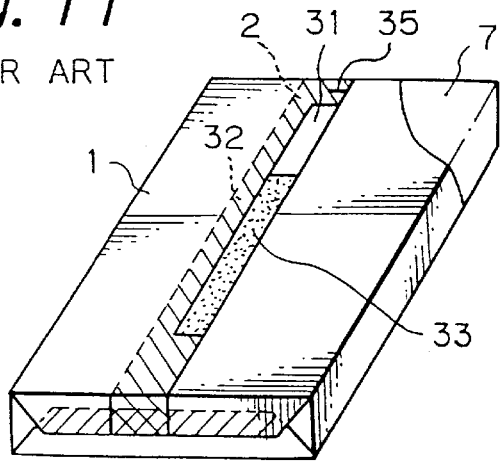
Fig. 11 PRIOR ART
FIG. 11 is a perspective view of a further tear tape-free film-wrapped article of the prior art.

A concrete adhesion pattern of weakly adherent zone is illustrated in FIGS. 6 and 6(*a*). The regions designated B are printed with non-adherent ink, and the regions designated A (A×A) are not printed and become adhesive for joining upon heat sealing. The dimensions of the regions A and B may, for example, be chosen as tabulated in the drawing. Then the proportions of the areas of opening (the weakest adherent) zone , weakly adherent zone in the region, weakly adherent zone , and outer weakly adherent zone to the total joined area will be approximately 10%, 55%, 40%, and 70%, respectively. As an alternative, these dimensions may be successively altered.

More practically, the opening zone 52 that constitutes the weakest joined zone (with an adhesion strength of about 520% on the basis of the average film adhesion strength of 100%) is made about 15 mm long. At least one end of the opening zone adjoins a weakly adherent zone about 20 mm long (with an adhesion strength of about 1560%), which in turn adjoins, on the outer side, a weakly adherent zone with a greater adhesion strength (about 2580%).

Next, a cut 54 is made from one edge portion 46 into the opening zone 52 or in the nearby area of the pattern. Preferably the cut is formed in a portion 2–3 mm away from the opening zone rather than in that zone. It then avoids accidental tear of the opening zone and permits easy opening of the zone when desired.

For convenience, the opening position and direction may be indicated in the usual manner by printed marks.

An article is wrapped with the wrap film of the structure described above, and the overlap between the upper and under edge portions 47, 49 is heat sealed to form a weakly joined zone 50. Subsequent heat shrinking produces, as shown in FIG. 3, a seal 44 consisting of an opening zone 52 that is the weakest joined part, weakly joined zones 50 contiguous to the both ends of the opening zone and having adhesion strength gradually increased toward the both ends of the package, and a cut 54.

Figure 4A:
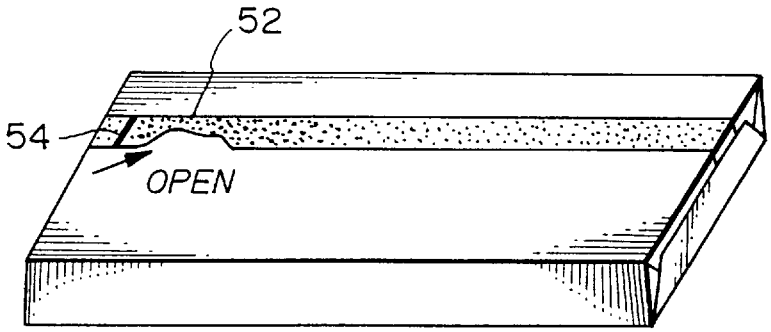
FIG. 4 is a sequence of views showing how the film-wrapped article is unwrapped.
Figure 4B:
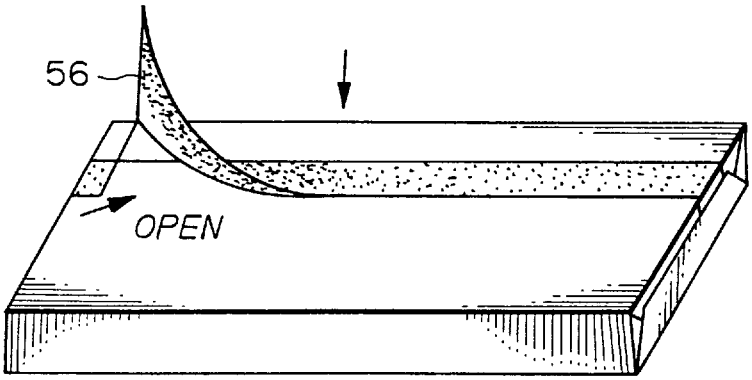
Figure 4C:
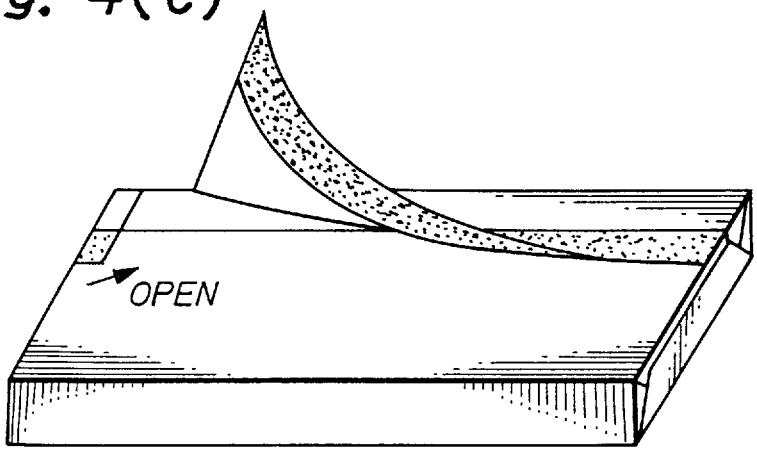

With reference to FIG. 4, explanation will now be made about how a film-wrapped article according to the invention is opened. As at FIG. 4(*a*), the opening zone 52 is pulled up with a nail and then with the finger. From the cut 54 tear 56 will then grow and allow the film portion on one side of the cut to be raised open as at FIG. 4(*b*). Further pull of the film enables the film to be peeled largely off, because the weakly joined zone 50 is easy to peel.

Second Embodiment

In FIG. 2 is illustrated another embodiment of the invention. Here a pattern to constitute a weakly joined zone 50 consists of a non-adherent ink region and adherent regions contiguous to the both ends of the non-adherent region, all in the form of lattices and shown in black. The area of the non-adhesive ink region in the pattern that forms the weakly joined zones is decreased stepwise from the opening zone 52 outwardly. The pattern comprises the opening zone 52 of the largest ink region area consisting of a most weakly adherent zone, weakly adherent zones 58 of smaller ink region area contiguous to both ends of the most weakly adherent zone, and another weakly adherent zone 60 of an even smaller ink region area farthest from the most weakly adherent zone. There is a cut 54 made in one of the weakly adherent zones 58 close to the opening zone 52. The individual zones are adjusted in adhesion strength through proportioning of their areas in the manner already described.

When an article is packaged using this wrap film in the way illustrated in FIG. 3, the adhesion strength of the weakly joined zones 50 increases stepwise as the distance from the opening zone 52 increases.

Third Embodiment

Figure 5:
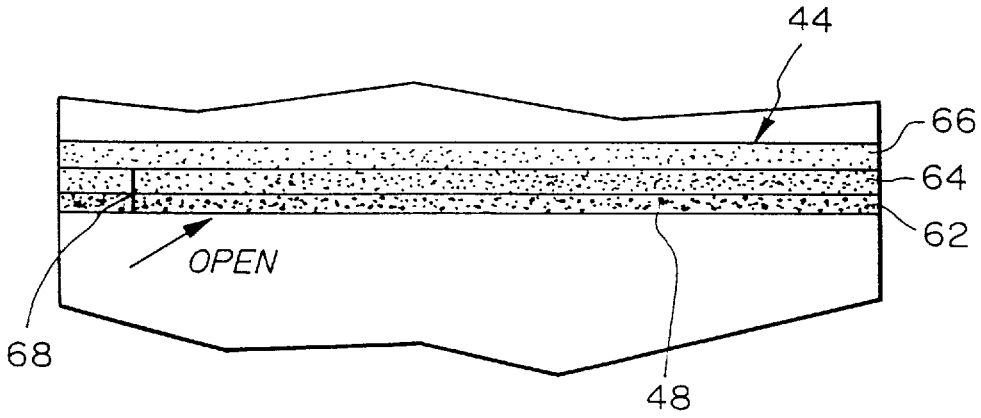
FIG. 5 is a fragmentary plan view of a third embodiment of a film-wrapped article of the invention.

Another embodiment of the invention will be described in conjunction with FIG. 5. There is shown a seal 44 of a package as wrapped, the seal extending from one end of the packaged article to the other. Weakly joined zones are formed in the seal, with their adhesion strength increased as the distance from the exposed end 48 of the upper edge portion of the wrap film increases, from a most weakly joined zone 62 toward the exposed end opposite to the end 48. A cut 68 is made in the upper edge portion from its exposed end 48 inwardly.

The unwrapping procedure described above applies to this embodiment as well.

According to the present invention, the seal in the wrap on the body of an article has no unjoined portion and is kept tight fitting, completely shutting out dust. There is no danger of unintended peel of the wrap during transport, because the farther its weakly joined zones are from the unwrapping point, the greater their adhesion strength. The weakly joined zones are made up of unjoined and joined regions with a repetition of lattice, mesh, dotted or other pattern. Through adjustment of the area ratio of those regions, the zones can be optimumly and easily formed with good productivity.

In unwrapping, the opening zone where the adhesion is the weakest is pulled out with a nail and then fingers. The whole wrap can then be peeled off instantly, because substantially all the body seal is made up of weakly joined zones.

The invention thus satisfactorily provides both good sealing and easy opening properties and facilitates the manufacture of film-wrapped articles.

What is claimed is:

1. A film-wrapped article consisting of a rectangular product wrapped with a heat-shrinkable plastic film in intimate contact with said product, upper and under edge portions of the film being overlapped and sealed together along the product to form a seal, a part of the seal on one side of the article being formed as a weakly joined zone whose adhesion strength increases by continuous or stepwise gradations from an opening zone where the adhesion strength is the lowest toward both ends of the article, said weakly joined zone being made up of joined and unjoined regions extending along the interface between said upper and under edge portions, in a repetitive pattern of the regions varying in adhesion strength by varying ratio of surface area of the joined region to surface of the unjoined region, and a cut being made in said opening zone or a zone adjacent to said opening zone of said upper edge portion.

2. The film-wrapped article of claim 1 wherein a weakly joined zone of greater adhesion strength than the opening zone is formed between one end of said article and said opening zone and said cut is made in that weakly joined zone, from the exposed end of the upper edge inwardly.

3. A film-wrapped article consisting of a rectangular product wrapped with a heat-shrinkable plastic film in intimate contact with the product, upper and under edge portions of the film being overlapped and sealed together along the product to form a seal, substantially all of the seal on one side of the article being formed as a weakly joined zone whose adhesion strength increases by continuous or stepwise gradations from a portion of a lowest adhesion strength along an exposed end of the upper edge portion toward an opposite end of the under edge portion, said weakly joined zone being made up of joined and unjoined regions extending along the interface between said upper and under edge portions, in a repetitive pattern of the regions varying in adhesion strength by varying ratio of surface area of the joined region to surface of the unjoined region, a cut being made in said upper edge portion from an exposed end of said upper edge inwardly.

* * * * *